United States Patent [19]

Scharpey

[11] Patent Number: 4,673,481

[45] Date of Patent: Jun. 16, 1987

[54] REDUCTION POT

[75] Inventor: Wilhelm Scharpey, Essen, Fed. Rep. of Germany

[73] Assignee: Swiss Aluminium Ltd., Chippis, Switzerland

[21] Appl. No.: 828,294

[22] Filed: Feb. 11, 1986

[30] Foreign Application Priority Data

Feb. 15, 1985 [CH] Switzerland ..... 720/85

[51] Int. Cl.[4] ..... C25C 3/08

[52] U.S. Cl. ..... 204/243 R; 204/294

[58] Field of Search ..... 204/243 R, 244–247, 204/67, 294

[56] References Cited

U.S. PATENT DOCUMENTS 4,052,288 10/1977 Sala ..... 204/243 R
4,175,022 11/1979 Vadla et al. ..... 204/243 R
4,411,758 10/1983 Hess et al. ..... 204/294 X
4,430,187 2/1984 Snaeland et al. ..... 204/243 R
4,548,692 10/1985 Scharpey ..... 204/243 R

*Primary Examiner*—Donald R. Valentine
*Attorney, Agent, or Firm*—Bachman & LaPointe

[57] ABSTRACT

A reduction pot for the production of aluminum by fused salt electrolysis comprises an outer steel shell, thermal insulation and an inner lining essentially of carbon with iron cathode bars embedded in it. The floor insulation comprises at least in part of a mechanically compacted layer of a granular material of ground insulation layers and having essentially a particle size that varies between 0.01 and 8 mm. The sidewalls of the reduction pot contain, up to at most 70% of the height (h) of the cathode bar elements, mechanically compacted granular material from ground insulation layers. Above that the thermally and electrically insulated steel shell is lined with sidewall bricks, and the gap between the sidewall bricks and the floor elements is closed off with the usual ramming mass.

11 Claims, 4 Drawing Figures

REDUCTION POT

BACKGROUND OF THE INVENTION

The present invention relates to an electrolytic reduction pot for the production of aluminum by fused salt electrolysis, said pot comprising an outer steel shell, thermal insulation and an inner lining essentially of carbon with iron cathode bars embedded in it, the floor insulation at least in part comprising a layer of mechanically compacted granular material of ground insulation layers and having essentially a particle size that varies between 0.01 and 8 mm.

For the production of aluminum by fused salt electrolytic reduction of aluminum oxide the latter is dissolved in a fluoride melt made up for the greater part of cryolite. The cathodically precipitated aluminum collects under the fluoride melt on the carbon floor of the cell where the surface of the molten aluminum forms the actual cathode. Dipping into the melt from above are anodes which in conventional processes are made of amorphous carbon. At the anodes, as a result of the electrolytic decomposition of the aluminum oxide, oxygen is produced which reacts with the carbon of the anodes to form $CO_2$ and CO. The electrolytic process takes place in a temperature range of approximately 940°–970° C.

The electrical energy consumed in the electrolytic process can be classified in two main categories:

Production or reduction energy energy losses.

The productive part of the energy that is consumed is required in order to reduce the $Al^{3+}$ cations to metallic aluminum. This productive part of the energy consumed can therefore not be lessened.

The energy losses on the other hand can be divided into various components all of which have the effect of dissipating heat losses to the surroundings. The heat produced in the electrolytic process always flows to the colder part of the pot; from there it escapes to the surroundings thus removing energy from the production process. These heat losses can be checked and must be brought to a minimum.

By using optimally suited materials for the electrical conductors the voltage drop and with that the energy losses in the electrical circuit can be reduced to a minimum.

For a long time now it has been customary to provide a thermally insulating layer in the outer steel shell in order to prevent the loss of heat through the pot or to reduce this to a low level. Usually brick made of diatomaceous earth or moler stone is employed. New moler stone materials have excellent insulating properties; they are however very sensitive to components of the electrolyte bath which penetrate the carbon lining. For this reason the insulating layer lying closest to the electrolyte bath is often made out of less temperature sensitive, electrolyte resistant, but poorer insulating firebrick. As such bricks can be readily stacked on top of each other, it is possible to insulate the sidewalls and the floor of the pot without any difficulty.

Proposed in the U.S. Pat. No. 4,052,288 is to grind the linings of spent reduction cells i.e. residual carbon and insulation, and then to treat this with a strong alkaline solution so that the fluorides of sodium and aluminum are removed. A binder, usually petroleum pitch, is then added to the filtrate to produce a paste for lining new reduction cells.

Described in the U.S. Pat. No. 4,430,187 is a reduction pot in which at least the lower 80% of the cell floor insulation is made up of a compacted vulcanic ash layer, the rest of the insulation on the cell floor of a leakage barrier which screens the vulcanic ash from the bath components penetrating the carbon lining.

Known from the U.S. Pat. No. 4,548,692 is that at least the lower 75% of the floor insulation can be of a mechanically compacted layer of a granular material having a particle size ranging essentially from 0 to 8 mm. This granular material contains the fully ground, but otherwise untreated insulation layers, without residual carbon which is mechanically sorted out before grinding, from scrapped electrolytic cells. The remaining 0–25% of the floor insulation is made up of a layer of firebrick, ground firebrick and/or smelter alumina. The sidewalls of the steel shell are insulated solely by firebrick.

SUMMARY OF THE INVENTION

The object of the present invention is to develop an electrolytic reduction pot for the production of aluminum by the fused salt electrolytic process, in which the manufacturing costs for the thermal insulation can be lowered further without the quality of the pot suffering in terms of thermal insulation and useful service life.

This object is achieved by way of the invention in that the sidewalls of the pot contain, up to 70% of the height of the cathode bar elements, mechanically compacted granulated material from insulation layers, above that the thermally and electrically insulated steel shell is lined with sidewall bricks, and the gaps between sidewall bricks and carbon floor elements are closed off with the usual ramming mass.

The sidewalls of the reduction pot preferably contain mechanically compacted granulated material at most up to the level of the upper edge or the uppermost mantle line of the iron cathode bars.

BRIEF DESCRIPTION OF THE DRAWINGS

The invention is described in greater detail in the following by way of example and with the aid of the schematic drawings.

DETAILED DESCRIPTION

Figure 1:
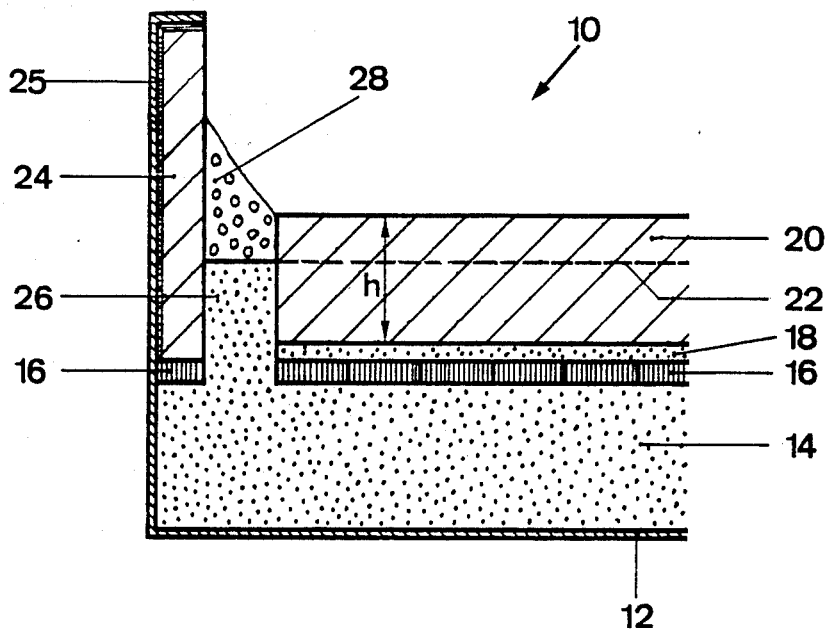
FIG. 1: Part of a reduction pot sectioned in the transverse direction.

If the carbon floor elements, made of amorphous carbon, semi-graphite or graphite, are arranged side-by-side in the reduction cell, and the paste which is well known to the expert in the field rammed into the gaps between them, then according to a further development of the invention at most the lower 70% can be replaced by mechaniclly compacted granulate of ground insulation layers. The carbonaceous ramming mass is deposited warm or cold above this and calcined during the start up of the reduction cell.

The ground granular material preferably has a particle size of 0.1–4 mm.

If a pot has to be replaced, the lining is broken up, removed, and in most cases thrown away. By using alumina as insulating material it is possible to recycle the aluminum oxide from the floor insulation, provided the necessary equipment for this is available at the smelter.

The use of moler stone materials and alumina as insulating materials represents a significant cost factor for an aluminum smelter as both materials are expensive. In conventional electrolytic cells the floor insulation is generally made up of three layers of moler stone bricks and a layer of firebrick which is more resistant to the electrolyte but also more expensive.

In the manufacture of the granular material these four brick layers are removed from the cell which is to be replaced, and then prepared by grinding. Any pieces of carbon which are present are first sorted out mechanically, likewise the larger pieces of solidified aluminum. The granulate, which has been ground but subjected to no further treatment, comprises mainly moler stone, to a lesser extent firebrick, and can also contain small amounts of aluminum.

The granular material can however also come from reduction pots whose insulation already contains or consists of ground pot linings. In the case of repeated use of such granulated material a pot which is to be replaced is first dismantled until the mechanically compacted granular material of the floor insulation is exposed. If this is still good, then the reduction pot is again built up with sidewall insulation without any further measures. Any agglomerated material is broken up, usefully by grinding. At the same time large pieces of carbon and/or aluminum are removed.

The preparation of the granular material can also take place in situ i.e. at the reduction cell in that, for example, a vibrating slide is pushed back and forwards up to 20 times.

Granulated material prepared outside the pot is poured dry into the cell and then mechanically compacted for example by ramming and/or vibration. Wet granulated material is usefully dried first.

The depth of the compacted granular layer incorporated in the floor insulation is preferably 250–400 mm. The uppermost 0–25% of the total depth of floor insulation can usefully be of a layer of firebrick, ground firebrick and/or smelter alumina. Alternatively or additionally, the lowest, likewise 0–25% of the total depth of floor insulation can be of moler stone brick or Skamolex brick. Skamolex is an insulating brick made by the Danish firm SKAMOL.

In order to provide the compacted granular layer of the floor insulation with better protection against molten electrolyte constituents penetrating the carbon lining, one can advantageously lay on the granular layer a steel foil or steel sheet which is usefully bonded to an impermeable, flexible graphite membrane (see for example TMS paper No. LM 78/19 or U.S. Pat. No. 4,175,022). The steel foil or sheet, if desired with graphite foil, acts as a barrier to the electrolyte.

Referring to the drawings, the reduction pot 10 shown in FIG. 1 features an outer steel shell 12 with a mechanically compacted, ground material 14 from spent pots bedded into it. Laid on this granular material is a layer of firebrick 16 which is covered with 5–10 mm of granular firebrick 18. Granular lining material 14, firebricks 16 and ground firebrick 18 form the floor insulation.

The carbon floor elements 20 lie horizontal on the ground firebrick 18 and form a layer of height h. The broken line 22 indicates the level of the upper edge or uppermost mantle line of the iron cathode bars which are not visible in the section shown here. The sidewall of the steel shell 12 is connected to the (carbon or silicon carbide) sidewall brick 24 via an electrically and thermally insulating layer 25 of firebrick tiles or silicon carbide mortar, which in the present case is of carbon and/or silicon carbide and extends down to the region of the carbon floor elements 20. The sidewall brick 24 rests on a supporting layer of firebrick 16.

The 20–25 cm wide gap 26 between the sidewall brick 24 and the carbon floor elements 20 is filled, up to the level 22 of the upper edge or uppermost mantle line of the iron cathode bars, with the granulated floor insulation 14 which has subsequently been mechanically compacted. On top of that is a conventional ramming material 28 which protects the granular material from undesired attack by the electrolyte in the reduction pot 10.

Of course the region at the side can be packed with other insulating materials not shown in FIG. 1.

Figure 2:
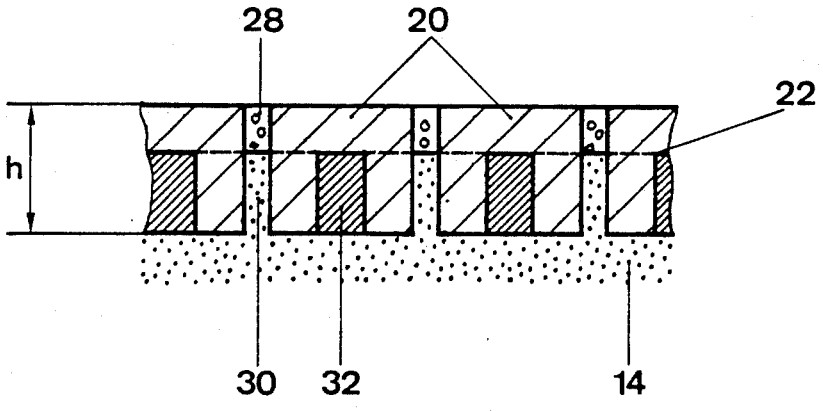
FIG. 2: Carbon floor elements joined by means of a ramming mass, sectioned in the longitudinal direction of the pot.

According to the version shown in FIG. 2 the carbon floor elements 20 of height h are arranged a distance apart and laid directly on the floor insulation which here is exclusively of granular material 14. The gaps 30 between the carbon floor elements 20 are filled to the level 22 of the upper edge of the iron cathode bars 32 with the same mechanically compacted granular material 14 as the floor insulation. Above that is the usual ramming mass 28.

Figure 3:
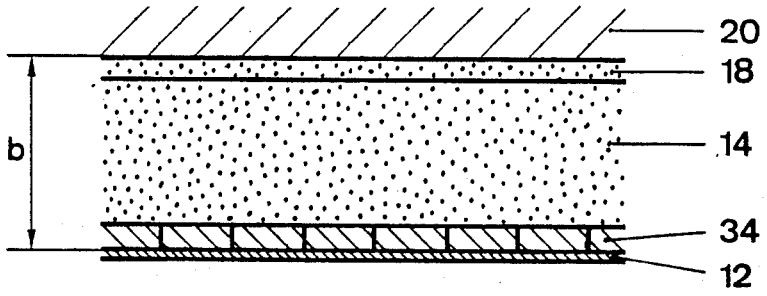
FIG. 3: Floor insulation.

The floor insulation of overall height b in FIG. 3 supports the carbon floor elements 20 which rest on an approximately 20 mm thick layer 18 of granulated firebrick. Below that is the mechanically compacted granular material 14 of ground insulation layers, which forms the main part of the floor insulation. The lowest part of the floor insulation is made up of a layer of moler stone brick 34. These bricks 34 exhibit excellent thermal insulation properties, but are not very resistant to electrolyte. The whole of the floor insulation is supported by the steel shell 12.

Figure 4:
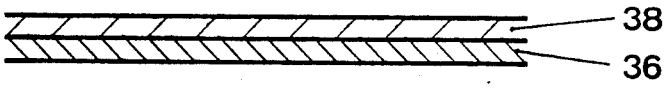
FIG. 4: A steel foil coated with a graphite foil.

Finally FIG. 4 shows a steel foil 36 which is coated with a graphite membrane 38 and is suitable for use as an electrolyte barrier directly above the mechanically compacted granular material 14.

A reduction pot fitted with the insulation according to the invention exhibits the following advantages:

- A considerable cost savings is achieved over conventional reduction cells with moler stone and firebrick insulation.
- To a large extent use can be made of brickwork from dismantled cells that are to be replaced.
- The use of granular material enables considerable savings in man hours of labor.
- The ground granular materials are saturated with fluorides and thus take up less fluoride when in service. As a result the consumption of cryolite and $AlF_3$ is less.
- No new blocks have to be cut.
- Transportation to the dump and the ever greater dumping costs are eliminated. Rubbish dumps for spent lining material have to be sealed at the bottom with calcium compounds.
- The reserves to be stored at the smelter can be reduced.
- The possibility of electrolyte and metal penetrating the insulation is less as there are no gaps, the firebrick and molar stone material are mixed and the corners and unevenness are more completely filled.

Temperature measurements made on cells that have been in service for an extended period have shown that the floors and outer walls of reduction pots fitted with insulation layers according to the invention do not reach higher temperatures than those of pots with conventional insulation layers. The thermal insulation is therefore at least equally good.

What is claimed is:

1. Reduction pot for the production of aluminum by fused salt electrolysis, comprising: an outer steel shell having a floor and sidewalls; an inner lining essentially of carbon with iron cathode bars; floor insulation comprising at least in part of a mechanically compacted layer of a granular material made from ground insulation layers and having a particle size that varies essentially between 0.01 and 8 mm; wherein the sidewalls contain at most up to 70% of the height (h) of the cathode bars of mechanically compacted, granulated material from insulation layers and sidewall bricks lining the steel shell extending above the sidewall granulated material and forming a gap between the sidewall bricks and carbon floor elements; and a ramming mass closing said gap.

2. Reduction pot according to claim 1 wherein the sidewalls of the pot contain granular material at most up to the level of the upper edge of the iron cathode bars.

3. Reduction pot according to claim 1 wherein the carbon inner lining has gaps therebetween, and wherein mechanically compacted granular material from ground insulation layers is provided in the gaps between the carbon inner lining up to at most 70% of their height, and above a ramming mass.

4. Reduction pot according to claim 1 wherein the ground granular material comprises mainly moler stone brick material, to a lesser extent of firebrick, and small inclusions of aluminum.

5. Reduction pot according to claim 1 wherein a layer of insulation is provided between the steel shell and the sidewall bricks.

6. Reduction pot according to claim 5 characterized in that the granular material is prepared in situ.

7. Reduction pot according to claim 5 wherein said insulation is firebrick tiles.

8. Reduction pot according to claim 5 wherein said insulation is silicon carbide mortar.

9. Reduction pot according to claim 1 wherein a layer of firebrick is provided below the sidewall bricks.

10. Reduction pot according to claim 1 wherein the uppermost 0–25% of the overall height of the floor insulation comprises a layer selected from the group consisting of firebrick, granulated firebrick and smelter alumina.

11. Reduction pot according to claim 1 wherein the lowest 0–25% of the overall height of the floor insulation comprises a material selected from the group consisting of moler stone and bricks.

* * * * *